US005493761A

United States Patent [19]

Bone

[11] Patent Number: 5,493,761

[45] Date of Patent: Feb. 27, 1996

[54] APPARATUS FOR FILLET ROLLING OF CRANKSHAFTS

[75] Inventor: Bramwell W. Bone, Midland, Mich.

[73] Assignee: Ingersoll CM Systems, Inc., Midland, Mich.

[21] Appl. No.: 328,026

[22] Filed: Oct. 24, 1994

[51] Int. Cl.[6] ..... B23P 15/00

[52] U.S. Cl. ..... 29/6.01; 29/888.08

[58] Field of Search ..... 29/6.01, 888.08; 72/110, 460, 465

[56] References Cited

U.S. PATENT DOCUMENTS

| | | | |
|---|---|---|---|
| 4,437,328 | 3/1984 | Wittkopp et al. | 29/6.01 |
| 4,554,811 | 11/1985 | Hayashi et al. | 29/6.01 |
| 4,646,551 | 3/1987 | Rut | 29/6.01 |
| 4,682,489 | 7/1987 | Bauerle et al. | 29/6.01 |
| 4,801,226 | 1/1989 | Gleason | 29/6.01 |
| 5,022,129 | 6/1991 | Gertz | 72/389 |
| 5,138,859 | 8/1992 | Winkens | 72/110 |

FOREIGN PATENT DOCUMENTS

| | | |
|---|---|---|
| 3108780 | 9/1982 | Germany . |
| 3108746 | 9/1982 | Germany . |
| 3108717 | 9/1982 | Germany . |
| 0024319 | 2/1985 | Japan . |
| 0183364 | 7/1989 | Japan . |
| 1823805 | 6/1993 | U.S.S.R. . |

*Primary Examiner*—Irene Cuda
*Attorney, Agent, or Firm*—Fitch, Even, Tabin & Flannery

[57] ABSTRACT

An apparatus for deep fillet rolling the undercut radii of crankshaft bearings, especially on a production scale basis. The apparatus is provided with increased versatility and flexibility for various engine crankshafts that may vary in number of pins and mains.

17 Claims, 10 Drawing Sheets

APPARATUS FOR FILLET ROLLING OF CRANKSHAFTS

BACKGROUND OF THE INVENTION

This invention relates to a method and apparatus for deep fillet rolling the undercut radii of crankshaft bearings, and more particularly, for deep fillet rolling the undercut radii of crankshaft bearings on a production scale basis.

This invention relates to deep fillet rolling of bearings of crankshafts, which is usually accomplished with a pair of opposed lever arms, each holding a rolling tool at a first end and connected to a hydraulic cylinder or the like at the other end. The cylinder is actuated to spread the other ends to pivot the first ends of the lever arms to apply a predetermined amount of force through the rollers to the crankshaft fillets. Crankshafts have both main bearings located along the central longitudinal axis and pin bearings, at which will be attached the piston rods at various angularly-spaced and radially-spaced positions relative to the central longitudinal and rotational axis of the crankshaft. The crankshaft is rotated during the fillet rolling and the levers and rollers oscillate during the rolling of the pins. The space between adjacent sets of adjacent rolling lever arms for the pins and mains is quite small for many crankshafts, particularly for engines having four, six or eight cylinders and used in the automotive industry.

It is difficult to roll simultaneously all of the pins and mains because of the lack of space between directly-adjacent bearings to accommodate two adjacent, rolling lever arm assemblies. In order to overcome this lack of spacing, adjacent transfer stations have been provided on a crankshaft machining transfer line in which one-half of the bearings, e.g., the odd-numbered bearings, are rolled by a set of lever rolling assemblies spaced from each other; then the crankshaft is shifted to a second transfer station at which the even-numbered bearings are rolled by a second set of lever assemblies that are spaced appropriately because of the absence of the odd numbered-rolling assemblies at this second station. A similar approach has been done in a single machine, where a set of rolling lever assemblies first does one set of pin bearings, e.g., the odd set of pin bearings; and then the pin rolling lever assemblies are shifted axially of the crankshaft and brought into rolling contact with the even-numbered pin bearings. Thus, one set of pin rolling assemblies may be used and spaced instead of using two closely adjacent sets of pin rolling assemblies. In this machine, the main bearing rolling assemblies are stationary, and do not translate in the manner of the pin rolling assemblies.

In the automotive industry, as well as other industries, it is often desired to change the engine displacement; and as a result, the throws on the crankshafts may be changed. Also, it is often desired to be able to perform deep fillet rolling of crankshafts for four, six or eight cylinder engines with the same apparatus. Moreover, it may be desired to use the same fillet rolling apparatus to roll V-block crankshafts or in-line crankshafts. This flexibility to machine various crankshafts is difficult to achieve for a number of reasons. By way of example, an apparatus set up with four stationary rolling tool assemblies for rolling main bearings separating three translatable rolling tool assemblies for rolling respective pairs of pins would be very capable of deep fillet rolling a V-6 cylinder crankshaft having four main bearings separating three respective pairs of pins. But, the same apparatus cannot roll an in-line 6 cylinder crankshaft having seven main bearings separating six pins or a V-8 cylinder crankshaft having five main bearings separating four respective pairs of pins. The apparatus would be ineffective for two reasons. First, there are not enough stationary rolling tool assemblies to roll the 7 main bearings of the in-line 6 cylinder crankshaft or the 5 main bearing of the V-8 cylinder crankshaft. Second, the three translatable rolling tool assemblies are incapable of translating to roll three of the pins on the in-line 6 cylinder crankshaft and two of the pins on the V-8 cylinder crankshaft. Thus, there is a need for a new and more flexible deep fillet rolling method and apparatus that is capable of machining crankshafts designed for a variety of engines.

SUMMARY OF THE INVENTION

In accordance with the present invention, a fillet rolling apparatus is provided with increased versatility and flexibility for various engine crankshafts that may vary in number of pins and mains and may be, for example, a crankshaft for an in-line engine or for a V-engine. This is achieved by being able, after rolling a first set of pins and mains, to retract both the main pin rolling assemblies and to shift the crankshaft axially relative to both the main and pin rolling means and to then roll a second set of pins and mains with the same rolling assemblies. Preferably, one or more of the main pin rolling means may be retracted to an inoperative position and locked out of use for those crankshafts having a smaller number of fillets to be rolled. Not only are the pin rolling means retracted from the crankshaft but also the main pin rolling means are retracted to expose the crankshaft completely for high speed spinning of the crankshaft or for inspection such as measuring run out.

In accordance with the present invention, the main bearing rolling tool assemblies and the pin rolling tool assemblies are mounted for movement between an engaging position where they may engage the crankshaft for rolling and an exposed or retracted position Where the crankshaft working position is completely exposed. That is, all of the pin and main rolling arm assemblies may be retracted to the exposed position at which time a crankshaft may be loaded or unloaded checked T.I.R., or spun at high speed. Shifting of both the pin and main rolling assemblies completely away from the crankshaft allows a number of operations, such as high speed oil spin-off and crankshaft tolerance inspection, to be performed while the crankshaft remains in its working position, thus increasing the overall efficiency of the manufacturing process.

Additionally, the reaction of all of the rolling tool assemblies allows for the axial movement of the crankshaft relative to rolling tool assemblies. This is an important aspect of the present invention because it results in manufacturing flexibility that is currently not available. The crankshaft is rotatably held in its working position by a workholder that can shift the crankshaft with respect to the rolling tool assemblies in their retracted position. This allows groups of main bearings and pins to be sequentially aligned with respective rolling tool assemblies so that the rolling tool assemblies can advance and deep fillet roll each group.

With the present invention, an apparatus having a fixed number of rolling tool assemblies can be adjustably configured to manufacture crankshafts designed for any number of cylinders and for in-line or V block configurations. This eliminates the undesirable duplication of manufacturing equipment required by current methods and apparatus.

In accordance with the present invention advance and retraction of the main bearing rolling tool assemblies and pin rolling tool assemblies are achieved by having the rolling tool assemblies travel along respective fixed axes that are perpendicular to the rotational axis of the crankshaft in the working position. The rolling tools can be retracted along their respective fixed axes so that they are completely clear from the working position to allow access for high speed spinning or for tolerance inspection of a crankshaft in the working position.

In accordance with another aspect of the present invention, each rolling tool assembly can be advanced or retracted independent of the other rolling tool assemblies. This allows a rolling tool assembly to remain clear of the working position when it is not required for the deep fillet rolling of a particular group of main bearings and pins. This prevents the rolling tool assemblies from interfering with the shifting workholder when different crankshaft configurations are deep fillet rolled, further increasing manufacturing flexibility.

In accordance with another aspect of the present invention, the positioning of the rolling tool assemblies relative to each other is adjustable along the length of the rotational axis of the crankshaft working position so that the rolling tool assemblies can be configured to align with any particular crankshaft design.

In accordance with the present invention, the advance and retraction of the rolling tool assemblies, the deep fillet rolling action of the rolling tool assemblies, the rotation of the crankshaft in the workholder, and the sequential shifting of the crankshaft in the workholder are all automatically controlled by software driven electronic controls which are easily altered to accommodate crankshafts of different designs.

The preferred crankshaft deep fillet rolling apparatus has a workholder for holding and driving a crankshaft for rotation about its rotational axis. The workholder is movable in the direction of the rotational axis for sequentially shifting the crankshaft relative to a set of rolling tool assemblies for the sequential deep fillet rolling of groups of main bearings and pins. The set of rolling tools assemblies consists of five main bearing rolling tool assemblies with four pin rolling tool assemblies spaced between the main bearing rolling tool assemblies. The rolling tool assemblies advance to and retract from their crankshaft engaging position along axes perpendicular to the rotational axis, with the main bearing rolling assemblies being mounted through a lower structure and the pin rolling assemblies being mounted through an upper structure. Each rolling tool assembly can advance and retract independent of the other rolling tool assemblies. The rolling tool assemblies are independently adjustable along the rotational axis of the crankshaft so that they can be configured to align with a crankshaft of any design.

The preferred configuration is capable of deep fillet rolling crankshafts designed for any number of cylinders and for in-line and V block configurations by adjusting the rolling tool assemblies to align with the particular design and then sequentially shifting the crankshaft and selectively advancing and retracting the rolling tool assemblies to sequentially deep fillet roll groups of main bearings and pins on the crankshaft. During any portion of the deep fillet rolling sequences, the rolling tool assemblies may be retracted and the crankshaft may be inspected for part tolerance compliance or spun at high speeds to remove excess machining oil.

BRIEF DESCRIPTION OF THE DRAWINGS

This and other advantages of the invention will become apparent from the following detailed description taken in conjunction with the accompanying drawings in which.

DETAILED DESCRIPTION OF THE PREFERRED EMBODIMENT

Figure 1:
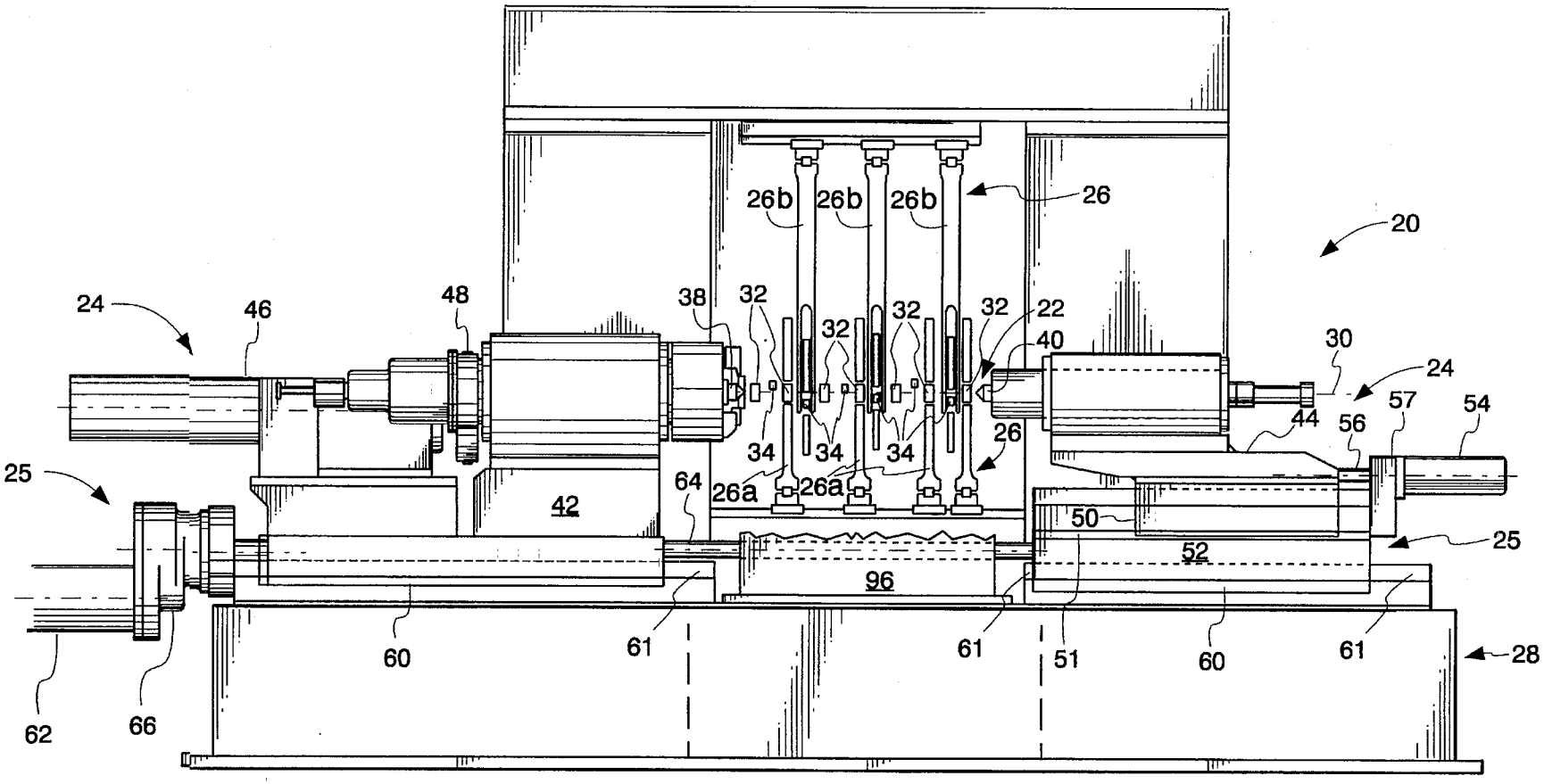
FIG. 1 is a front elevational view of an apparatus for simultaneously deep fillet rolling multiple crankshaft main bearings and pins and embodying the present invention.

As shown in the drawings for purposes of illustration, the invention is embodied in a machining apparatus 20 for deep fillet rolling the undercut radii of a crankshaft 22. As best seen in FIG. 1, the apparatus includes an adjustable support means or workholder 24 for supporting, rotating, and positioning the crankshaft in a working position relative to a plurality of rolling means which in the illustrated embodiment are shown in the form of rolling tool assemblies referred to generally by reference number 26. The rolling tool assemblies 26 engage the crankshaft 22 to deep fillet roll the undercut radii of the crankshaft 22 when the crankshaft 22 is rotated about a rotational axis 30 by the adjustable workholder 24. The rolling tool assemblies 26 are divided into main rolling tool assemblies **26*a* dedicated to deep fillet rolling the main bearings 32 of the crankshaft 22 (FIGS. 5A and 5B) and pin rolling tool assemblies 26*b* dedicated to deep fillet rolling the pins 34 of the crankshaft. The adjustable workholder 24 and the rolling tool assemblies 26 are mounted to a machine base or frame 28 for selective movement relative to each other. Software driven electronic controls are used to control the rotation of the crankshaft in the adjustable workholder 24, the amount of deep fillet rolling force applied by the rolling tool assemblies 26, and the movement of the adjustable workholder 24 and the rolling tool assemblies 26** relative to each other.

Figure 5A:
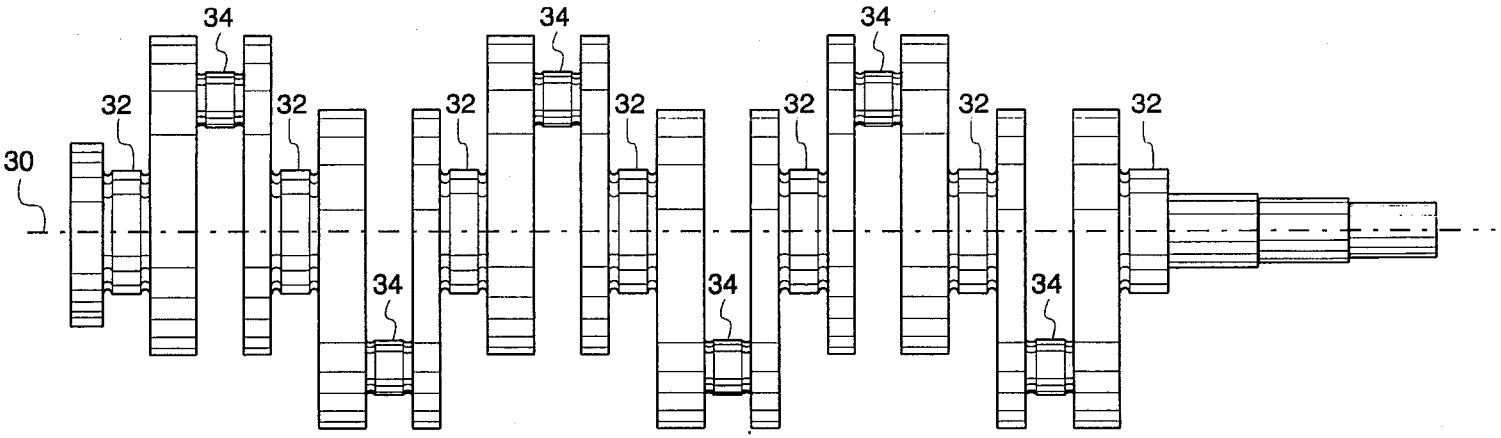
FIG. 5A is a side elevational view of an in-line six cylinder crankshaft.
Figure 5B:
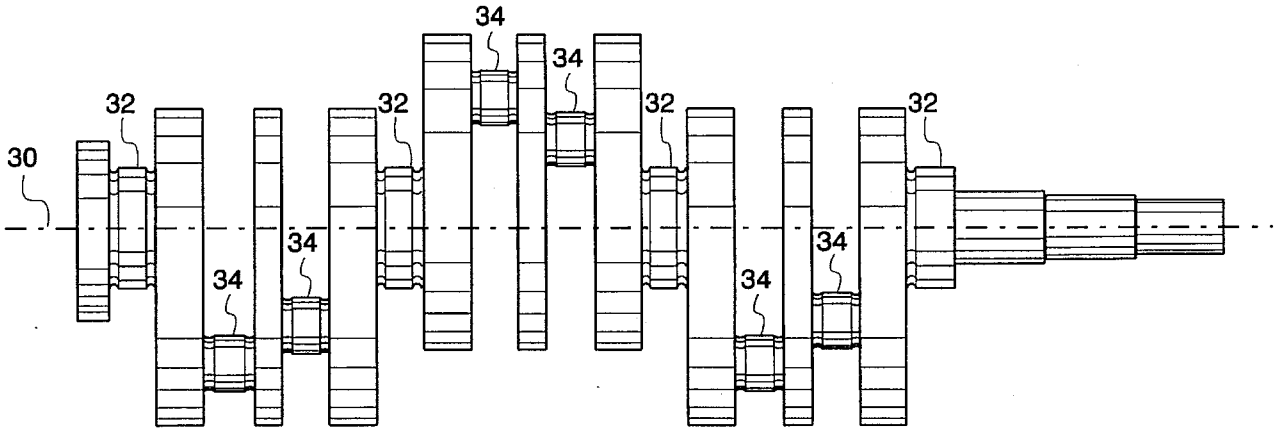
FIG. 5B is a side elevational view of a V-six cylinder crankshaft.

The crankshaft 22 has a longitudinal or rotational axis 30 (FIGS. 5A and 5B) about which the crankshaft 22 will rotate when it is in an engine. The crankshaft 22 rotates in an engine about the longitudinal axis 30 on main bearings 32 which are journaled in the engine block. The crankshaft will have an offset pin 34 for each piston of an engine. Each pin 34 journals a piston rod (now shown) for a piston. The number of main bearings 32 and pins 34 and their relative arrangement is dependent on the number of cylinders in the particular engine and on the arrangement, either in-line or V, of the cylinders in the engine. Typically, an in-line crankshaft, as shown in FIG. 5A, will have each pin 34 spaced by a pair of main bearings 32, while a V crankshaft, as shown in FIG. 5B, will have pairs of pins 34 spaced by pairs of main bearings 32. Crankshafts with varying numbers of main bearings 32 and pins 34 and with varying relative arrangements of main bearings 32 and pins 34 should be rolled with the same apparatus. There is a need for flexible, deep rolling apparatus to accommodate these varying designs of crankshafts with the requisite machining accuracy and production capabilities.

Figure 2A:
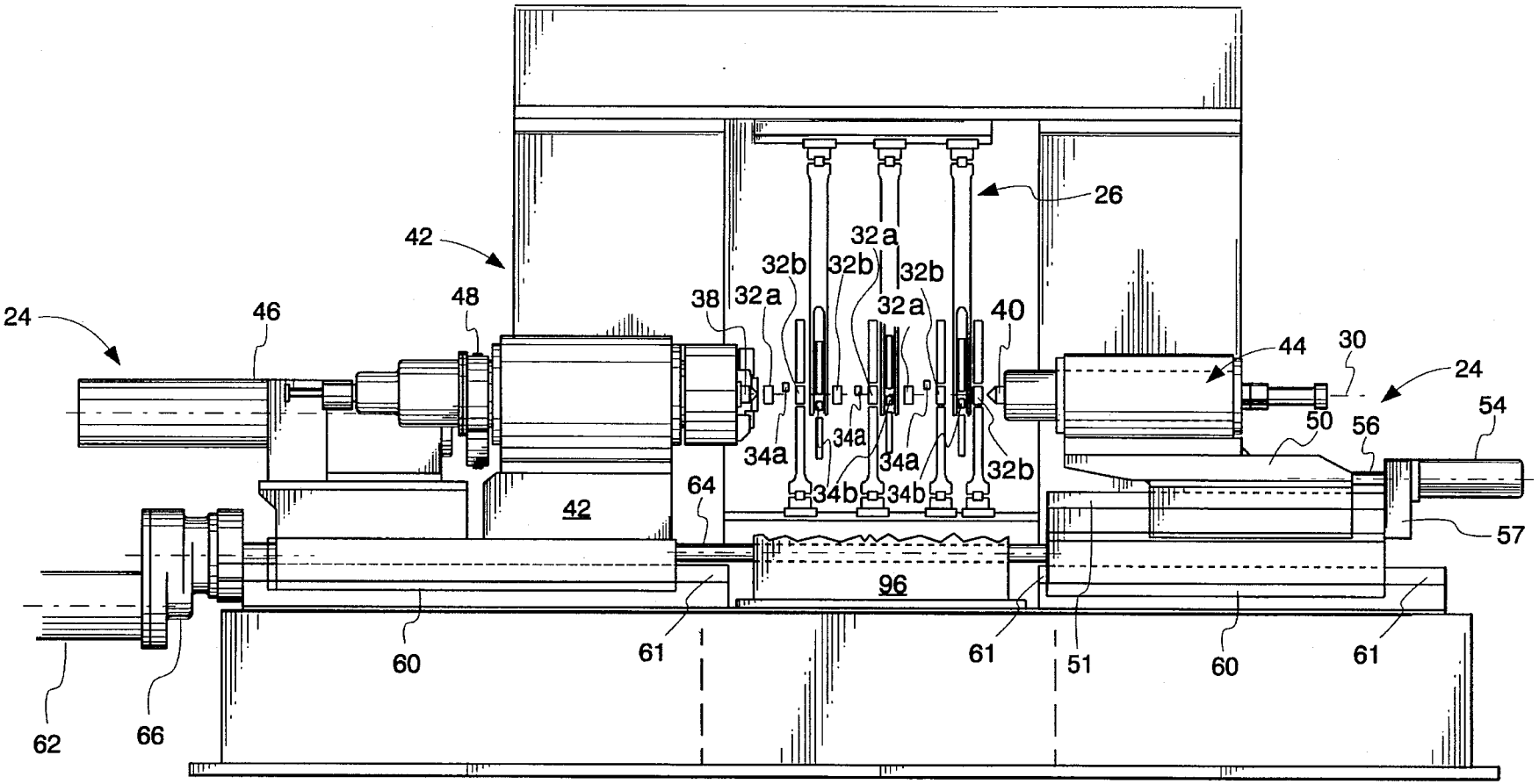
FIG. 2A is another front elevational view of the apparatus shown in FIG. 1, engaging a first group of main bearings and pins on a crankshaft for deep fillet rolling.
Figure 2B:
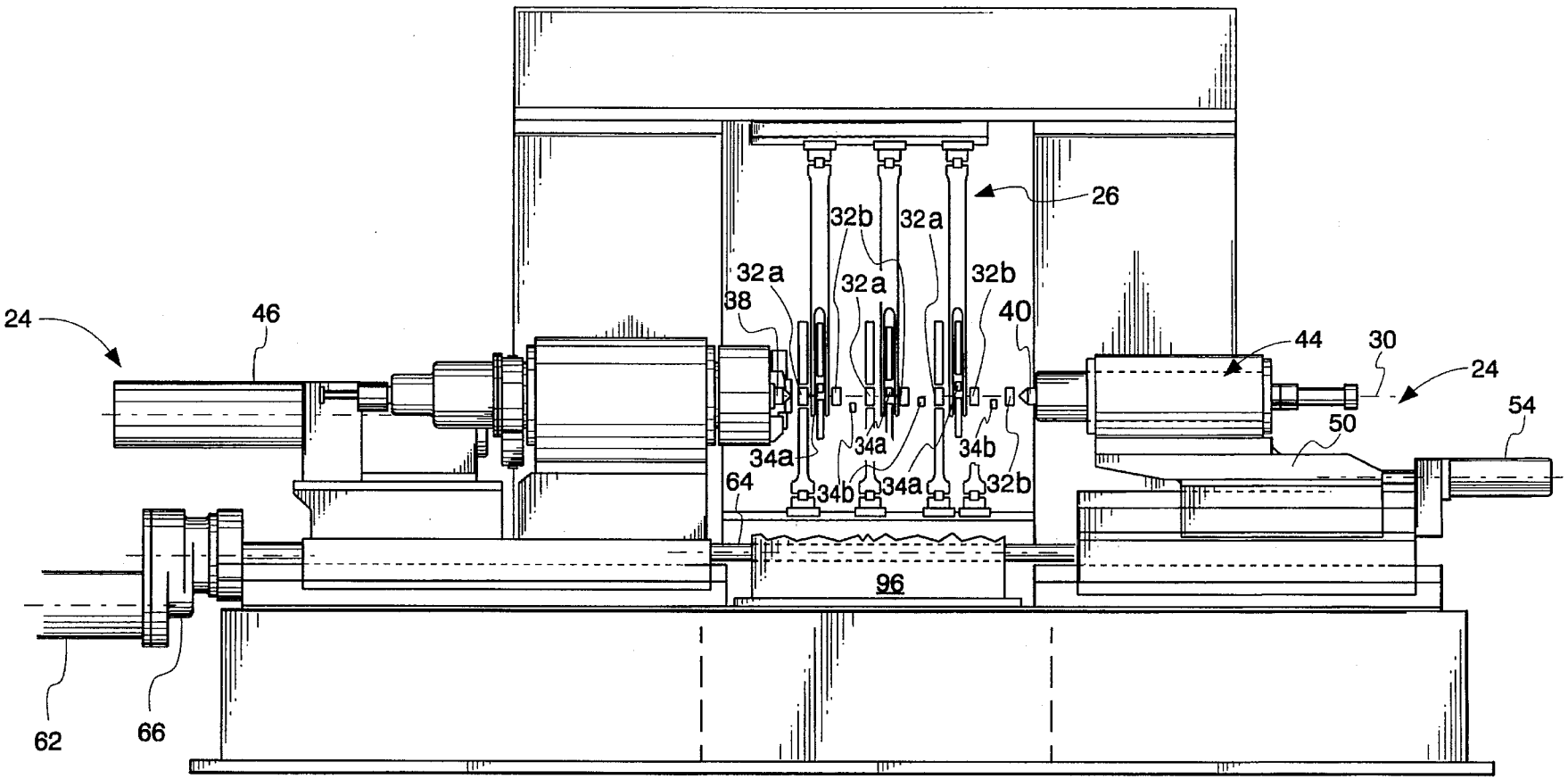
FIG. 2B is a front elevational view of the apparatus shown in FIG. 2A, engaging a second group of main bearing and pins on the crankshaft for deep fillet rolling.

In accordance with the present invention, the crankshaft 22 is readily positioned relative to the rolling tool assemblies 26 by the adjustable workholder 24 which includes positioning means 25 that mount the adjustable workholder 24 to the frame 28 for parallel movement to the rotational axis 30. The adjustable workholder 24 shifts the crankshaft 22 relative to the rolling tool assemblies 26 to align groups of main bearings 32 and pins 34 for the sequential deep rolling of the crankshaft. As seen in FIG. 2A, a first group of main bearings **32*a* and pins 34*a* are engaged by the rolling tool assemblies 26 for deep fillet rolling, while a second group of main bearings 32*b* and pins 34*b* remain free of the tool assemblies. After the deep fillet rolling of the first group of main bearings 32*a* and pins 34*a*, the adjustable workholder shifts the crankshaft, from the position shown in FIG. 2A to the position in FIG. 2B, so that the second group of main bearings 32*b* and pin 34*b* are aligned with and engaged by the rolling tool assemblies 26 for deep fillet rolling. By using the same rolling tool assemblies 26 to deep roll multiple groups of main bearings 32 and pins 34, a limited number of rolling tool assemblies 26 can deep fillet roll a crankshaft 22 having a number of main bearings 32 and pins 34 greater than the limited number of rolling tool assemblies 26**.

Figure 3A:
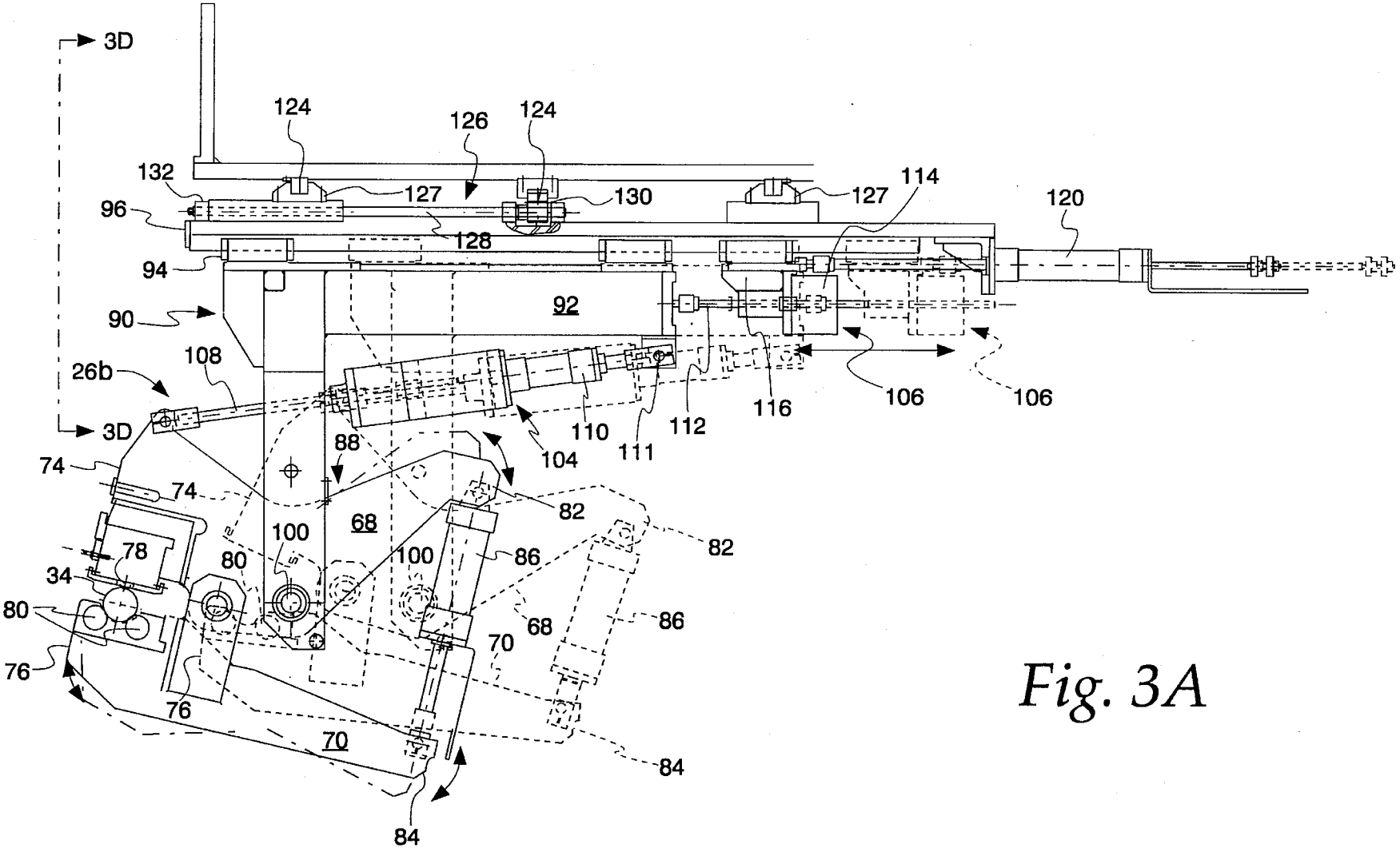
FIG. 3A is a side elevational view of one of the pin rolling means of the apparatus shown in FIG. 1, with the pin rolling means shown in the engaging and the exposed positions.
Figure 4A:
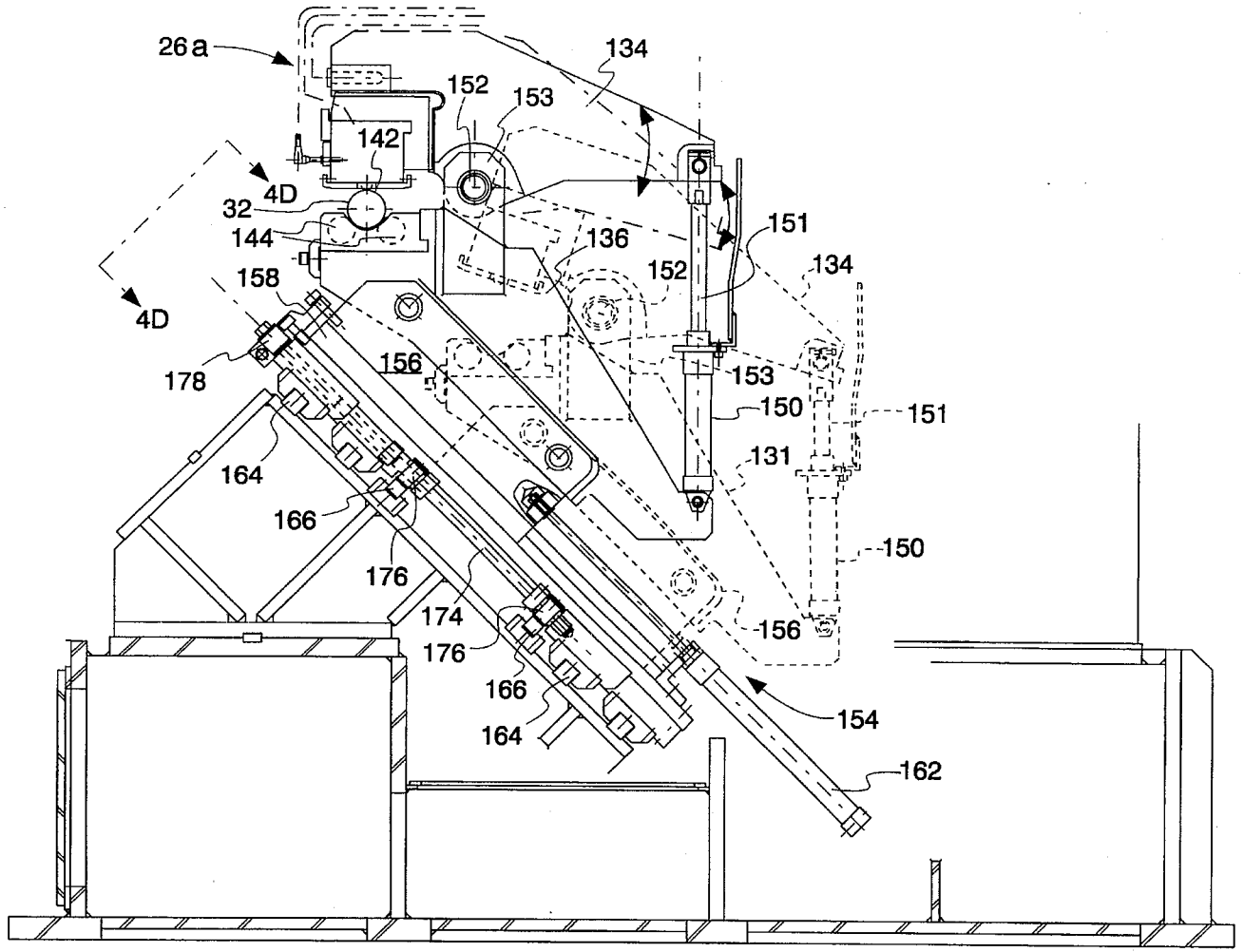
FIG. 4A is a side elevational view of one of the main rolling means shown in the engaging and the exposed positions.

In accordance with an important aspect of the invention, the crankshaft 22 and the working position can be exposed for operations other than deep fillet rolling by movement of the rolling tool assemblies 26 away from the crankshaft. Both the main and the pin rolling tool assemblies, **26*a* and 26*b*, are slidably mounted by mounting means to the frame for movement between an engaging position where the rolling tool assemblies 26 engage the crankshaft and an exposed position where the rolling tool assemblies 26 are positioned so that the crankshaft 22** and the working position are exposed for operations other than rolling as shown in FIG. 3A and 4A.

Figure 3B:
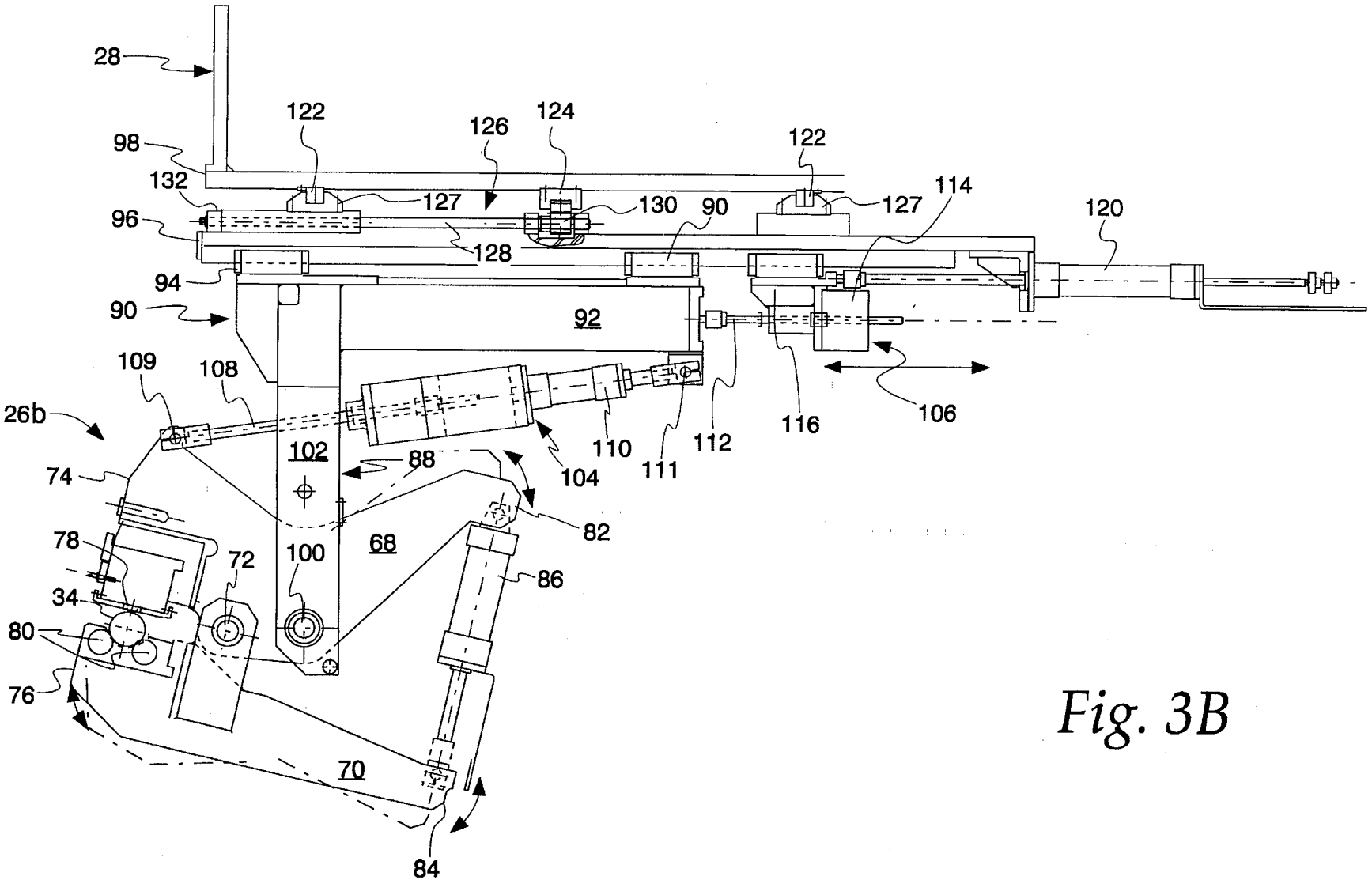
FIG. 3B is a side elevational view of the pin rolling means of FIG. 3A shown in the engaging position.
Figure 3C:
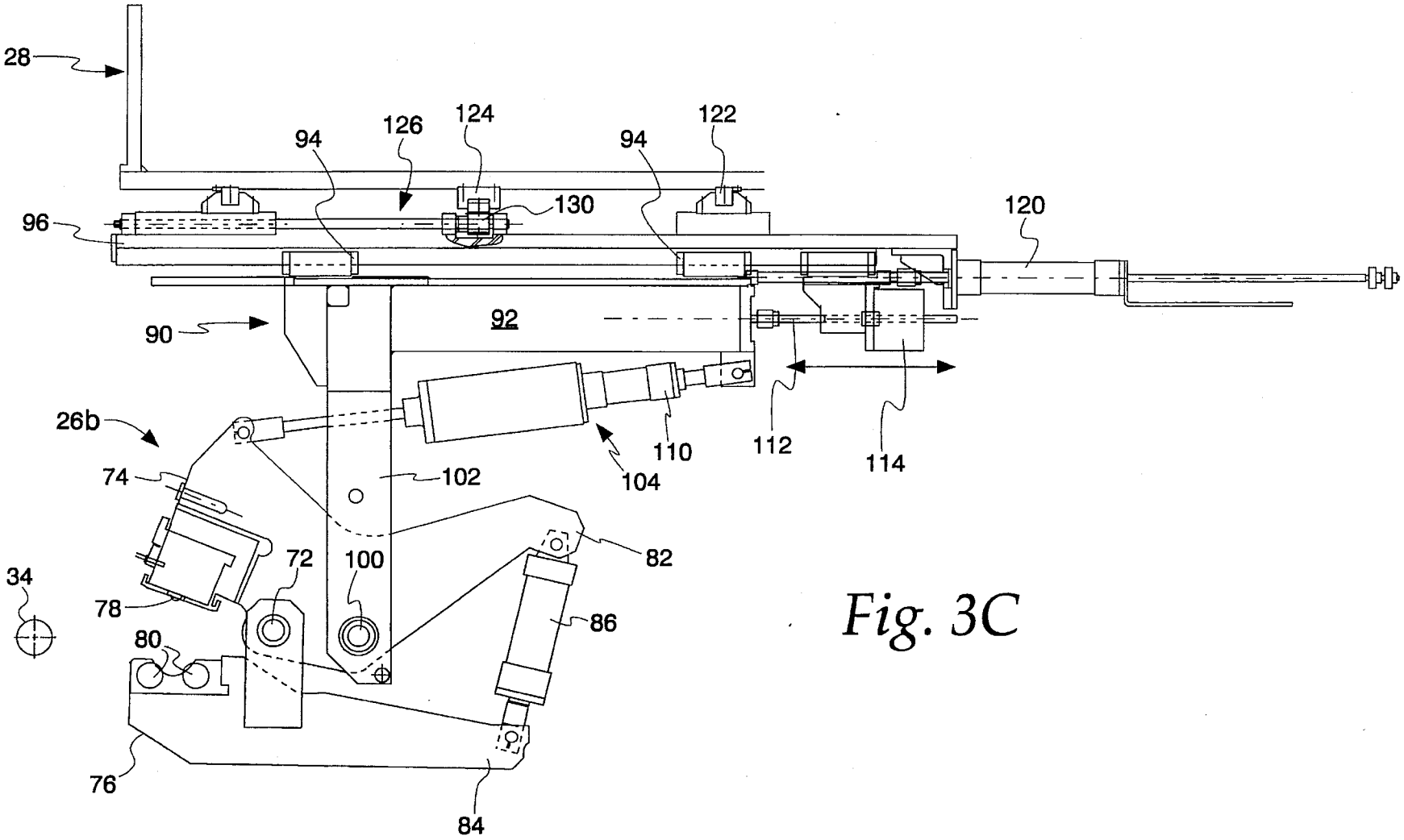
FIG. 3C is a side elevational view of the pin rolling means of FIG. 3A shown in the exposed position.
Figure 4B:
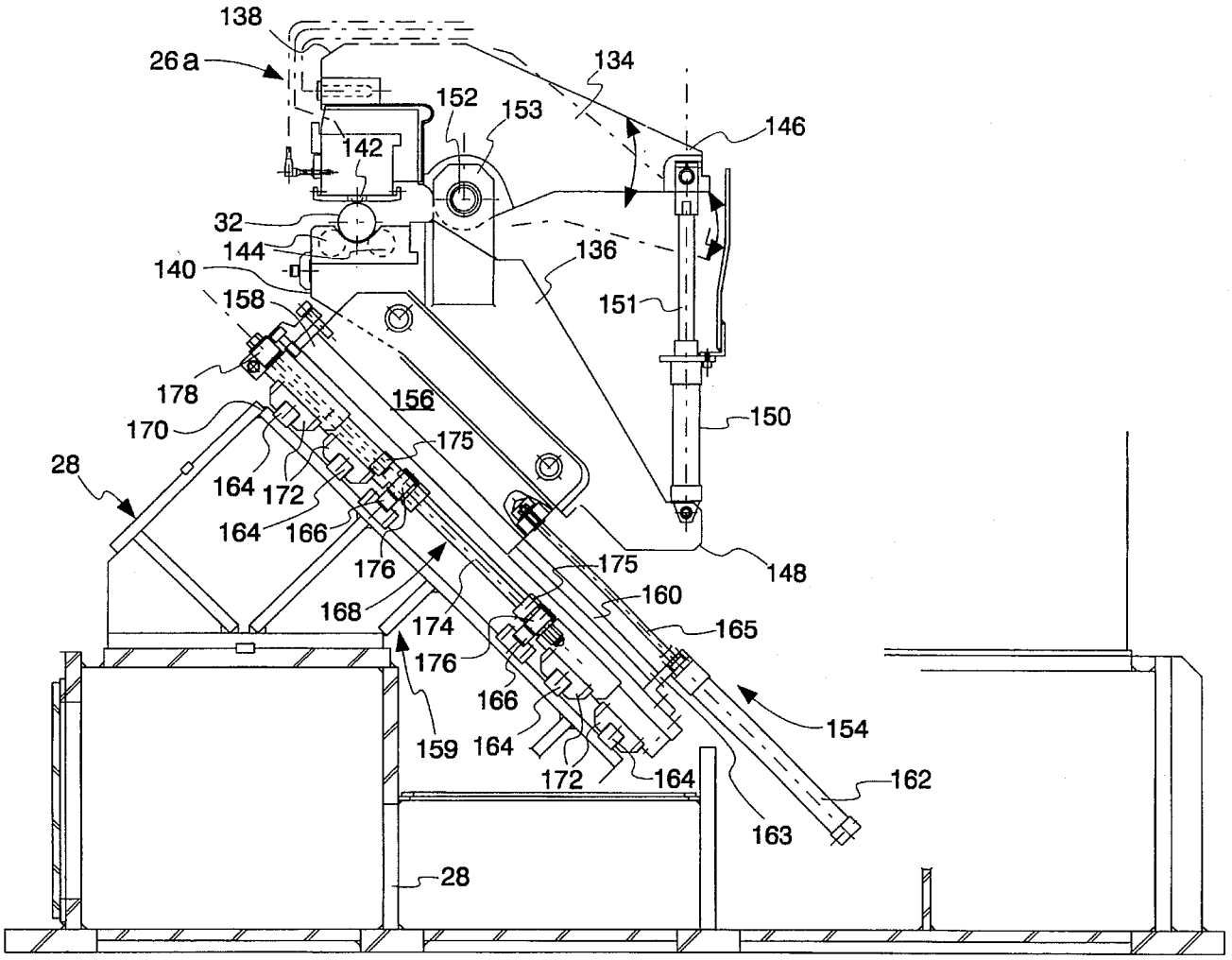
FIG. 4B is a side elevational view of the main rolling means of FIG. 4A shown in the engaging position.
Figure 4C:
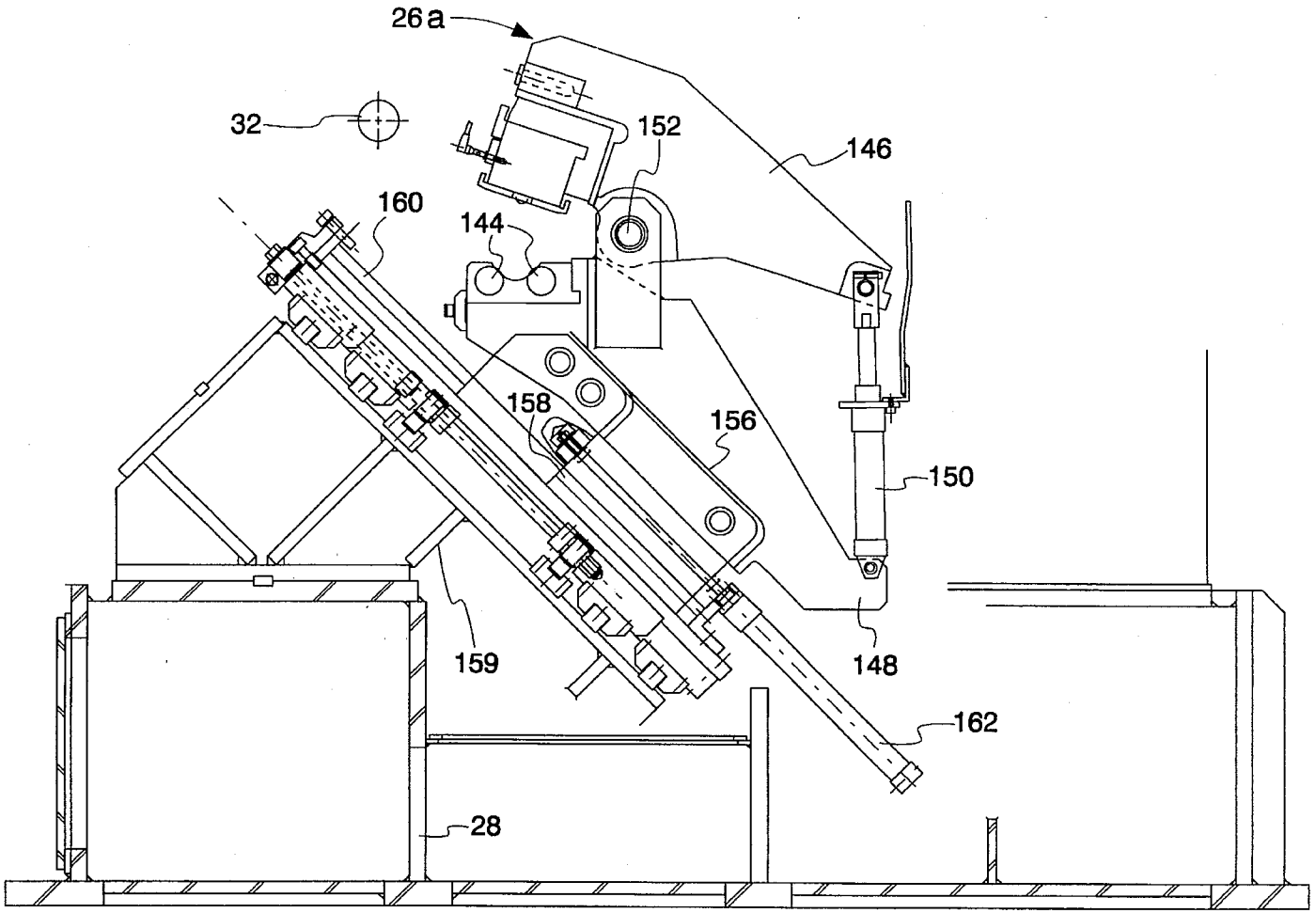
FIG. 4C is a side elevational view of the main rolling means of FIG. 4A shown in the exposed position.

As shown in FIG. 3C and FIG. 4C, movement of both the main rolling assemblies **26*a* and the pin rolling assemblies 26*b* to the exposed position provides adequate clearance for the aforementioned sequential axial shifting of the crankshaft 22 relative to the rolling tool assemblies 26. Further, movement of the main rolling tool assemblies 26*a* to the exposed position allows each main rolling tool assembly 26*a* to deep fillet roll multiple main bearings 32 on the crankshaft 22 and each pin rolling tool assembly 26*b* to deep fillet roll multiple pins 34 on the crankshaft 22, even if the pins 34 are separated by the main bearings 32 on the in-line crankshaft shown in FIG. 5A. Thus, the two functions, shifting of the adjustable workholder 24 and movement of the rolling tool assemblies 26 from an engaging position to an exposed position, create the versatility and flexibility to allow the deep fillet rolling of crankshafts of varying designs. As clearly seen in FIG. 3C and in the dotted line position of FIG. 4, the rearward movement of both the pin and main bearing, rolling tool assemblies leaves the crankshaft open and exposed and only supported at ends in chuck 38 and quill 40** (FIG. 1).

Movement of all the rolling tool assemblies 26 to the exposed position also allows for operations that are beneficially performed while the crankshaft 22 remains in the working position. High speed spinning of the crankshaft 22 to remove excess oil and tolerance inspection of the crankshaft are examples of such operations. Additionally, both automatic and manual loading and unloading of crankshafts to and from the working position are simplified because there is no interfering tooling to contend with, as clearly shown in FIG. 3C.

In accordance with the invention, the versatility and flexibility of the apparatus 20 is enhanced by allowing each rolling tool assembly 26 to be adjustably positioned along the rotational axis 30 so that they can be configured to align with different bearing positions for different crankshaft designs. Each main and pin bearing rolling tool assembly, **26*a* and 26*b*, may be selectively positioned along the rotational axis 30 independent of the other rolling tool assemblies 26. This allows the rolling tool assemblies 26 to be aligned for engagement with the main bearings 32 and pins 34 of crankshaft 22. It is typical for the main bearing and pin arrangement of crankshafts to be repetitive along the length of the crankshaft. Thus, rolling tool assemblies aligned to engage a first group of main bearings 32 and pins 34 of the crankshaft 22 will be in correct alignment to engage the remaining repetitive groups of main bearings 32 and pins 34 along the length of the crankshaft 22** after the crankshaft is shifted axially.

Another important aspect of the invention is the ability to deep fillet roll groups of main bearings 32 and pins 34 using less than the full compliment of rolling tool assemblies 26 mounted on the apparatus 20. Each main and pin rolling tool assembly, **26*a* and 26*b*, is mounted for movement between the engaging position and the exposed position independent of the other rolling tool assemblies 26. This allows each rolling tool assemblies 26 to selectively remain in the exposed position when they are not required to deep fillet roll a particular group of main bearings 32 and pins 34. For example, an apparatus 20 having four pin rolling tool assemblies 26*b* and five main rolling tool assemblies 26*a* can sequentially deep fillet roll a first group having four mains and three pins and a second group having three mains and three pins, or alternatively, a first group having four mains and three pins and a second group having zero mains and three pins, or as another alternative, a first group having five mains and four pins and a second group having zero mains and four pins. It can be seen that such an apparatus 20, can sequentially deep fillet roll any group having four or less mains 32 and four or less pins 34, for a total of 25 different possible group combinations of mains 32 and pins 34**. This increases flexibility not only in the number of different crankshaft configurations a particular apparatus can deep roll, but also in the combination of rolling sequences available to any one crankshaft configuration.

In accordance with an important aspect of the invention, software driven electronic controls are used to control the rotation of the crankshaft 22 by the adjustable workholder 24, the deep fillet rolling applied by the rolling tool assemblies 26, movement of main and pin rolling tools assemblies 26 between the engaging position and the exposed position, and the sequential axial shifting of the crankshaft 22 by the adjustable workholder 24.

Turning now in greater detail to the description of the invention, support and rotation of the crankshaft 22 are provided by the adjustable workholder 24 which includes a left holder or chuck 38 and a right holder or quill 40 for holding the crankshaft 22 at its respective ends as seen in FIG. 1. The crankshaft is centered in the holders 38 and 40 to rotate about its rotational axis 30. The adjustable workholder 24 also includes a left shifting carriage 42 which rotatably mounts the chuck 38 on bearings and a right adjusting sub-carriage 44 which rotatably mounts the quill 40 on bearings. The crankshaft 22 is driven by a motor 46 driving the chuck 38 through a transmission 48, with both the motor 46 and the transmission 48 being mounted on the left shifting carriage 42 for travel therewith.

In order to load and unload crankshafts 22 in the respective holders 38 and 40, the workholders 38 and 40 are shiftable toward or from one another. To this end, when it is desired to release a crankshaft 22 from the holders, the right-hand, sub-carriage 44 is shifted to the right as viewed in FIG. 1 to release the right hand of the crankshaft. The sub-carriage 44 is mounted on a main carriage 52 for slidable movement relative to the main carriage 52. More specifically, the sub-carriage has slidable, linear bearings 50 for sliding along a horizontal bearing or way 51 on the main carriage 52 when a driving screw 56 turns in a nut (not shown) in the sub-carriage. A drive motor 54 is mounted by a bracket 57 on the main carriage and turns the screw 56 in the sub-carriage nut to shift the sub-carriage left or right, in order to clamp or unclamp a crankshaft between the respective holders.

To accommodate longer or shorter crankshafts for four, six or eight cylinder engines, the two main carriages 42 and 52 are shifted simultaneously toward or from one another through equal increments relative to the frame base 28 and the tool assemblies 26 mounted thereon. This is achieved by use of a common drive motor 62 turning a common drive screw 64 extending between these main carriages, and having opposite hand screw threads thereon in the respective nut (not shown) in the respective main carriages 42 and 52.

The carriages 42 and 52 are slidably mounted to the frame 28 on linear bearings 61 and rails 60 for movement parallel to the rotational axis 30. The left and right shifting carriages 42 and 52 are driven together along the rotational axis 30 by a motor 62 driving a transmission 66 which turns the common drive screw 64 which is in threaded engagement with both the left and right shifting carriages 42 and 52. The motor 66 and the transmission 66 are secured on the frame and the drive screw 64 is rotatably supported in a support housing 96 fixed to the frame 28 between the left shifting carriage 42 and the right shifting carriage 52.

When it is desired to shift the crankshaft 22 axially to allow the second set of rolling tools **26*b* to perform the second rolling operation, after the rolling by the first set of rolling tools 26*a*, the main carriages 42 and 52 are shifted together without releasing the crankshaft being held in the holders 38 and 40. Thus, the motor 62 drives the transmission 66 turning the common drive screw 64 which moves the left and right shifting main carriages 42 and 52 together as a unit in a direction parallel to the rotational axis 30**.

Deep fillet rolling of the pins 34 is provided by the pin rolling tool assemblies **26*b*, each of which includes an upper lever arm 68 and a lower lever arm 70, mounted together by a pivot 72 as seen in FIG. 3B. Each lever arm 68 and 70 has a first end 74 and 76 and a second end 82 and 84. The first ends 74 and 76 hold rolling tools 78 and 80 opposing each other. The second ends 82 and 84 oppose each other and engage a rolling force cylinder 86 for applying rolling force through the rolling tools 82 and 84 to the crankshaft 22. The pin rolling tool assemblies 26*b* apply rolling force to the pin fillets when the rolling force cylinder 86 forces the second ends 82 and 84 of the lever arms 68 and 70 away from each other thereby pivoting the lever arms 68 and 70 around the pivot 72 and forcing the rolling tools 78 and 80 held in the first ends 74 and 76 into forcible engagement with the pins 34**.

Those skilled in the art will appreciate that there are other rolling tool configurations that are effective for deep fillet rolling crankshafts. Additionally, there are other configurations for forcibly engaging such rolling tools with a crankshaft. These other different configurations can be utilized in the invention to provide the specific function of deep fillet rolling of the crankshaft.

It will be appreciated that as the crankshaft 22 is rotated about its rotational axis 30, the pins 34 oscillate about the rotational axis 30 due to their offset from the rotational axis. Guided articulation of each pin rolling tool assembly **26*b* for following the oscillatory motion of the pins 34 is provided by pivot means 88 mounted to a slide means 90 guided on the frame 28 for movement perpendicular to the rotational axis 30 of the crankshaft 22. The slide means 90 includes a reciprocating slide carriage 92 mounted by linear bearings 94 to a retract guide rail 96 attached to an upper member 98 of the machine frame 28 for reciprocating linear motion perpendicular to the rotational axis 30. The pivot means 88 includes a pivot 100 mounted in a support 102 rigidly fixed to the reciprocating slide carriage 92. The oscillatory motion of the pins 34 can be broken down into a vertical component and a horizontal component. The upper lever arm 68 is mounted to the pivot 100 so that the pin rolling tool assembly 26*b* can rock up and down about the pivot 100 to follow the vertical component of the oscillatory motion of the pins 34. The pivot 100 and support 102 then mount the pin rolling tool assembly 26*b* to the reciprocating slide carriage 92 so that the pin rolling tool assembly 26*b* can reciprocate back and forth to follow the horizontal component of the oscillatory motion of the pins 34. Thus, the pin rolling tool assembly 26*b* rocks up and down about the pivot 100 and reciprocates back and forth with the reciprocating carriage 92 to follow the oscillatory motion of the pins 34 as the crankshaft 22** is rotated.

It will be appreciated that to engage the pins 34, each pin rolling tool assembly **26*b* must be orientated to match the orientation of its respective pin about the rotational axis 30 of the crankshaft 22 when the pin rolling tool assembly is in the engaging position. This function is provided by a first variable locking mechanism 104 which locks the rocking motion of the pin rolling tool assembly 26*b* and a second variable locking mechanism 106 which locks the reciprocating motion of the pin rolling tool assembly 26*b*. The first variable locking mechanism 104 has a first sliding link 108 pivotally mounted to the upper arm 68 and a second sliding link 110 pivotally mounted by a pivot pin 111 to the reciprocating carriage 92. The first and second sliding links 108 and 110 engage each other for sliding motion and may be locked against each other to prevent rocking of the pin rolling tool assembly 26*b* about pivot 100. The second variable locking mechanism 106 has a threaded sliding link 112 fixed to the reciprocating slide 92 and a locking block 114 fixed to a retract carriage 116 which is slidably mounted on linear bearing 118 on the retract guide rail 96 for linear movement in a plane which is perpendicular to the rotational axis 30 of the crankshaft 22. The locking block 114 guides the sliding link 112 for reciprocating motion and is capable of locking the sliding link 112 to prevent reciprocation motion of the pin rolling tool assembly 26*b***.

Movement of the pin rolling tool assembly 26b between the engaging position shown in FIG. 3B and the exposed position shown in FIG. 3C is provided by a force applying cylinder 120 fixed to the retract guide rail 96 and to the retract carriage 116 so that linear force can be applied to the retract carriage 116. To move the pin rolling tool assembly 26b from the engaging position to the exposed, rotation of the crankshaft 22 is stopped, then the first and second locking mechanisms 104 and 106 lock the pin rolling tool assembly 26b in its current orientation engaging pin 34 of the non-rotating crankshaft 22, then the rolling force cylinder 86 pulls the upper and lower arms 68 and 70 to disengage the rolling tools 78 and 80 from the pin fillets, and finally, the force applying cylinder 120 applies a linear retract force to the retract carriage 116 which is locked to the reciprocating carriage 92 by the second locking mechanism 106 thereby moving the pin rolling tool assembly 26b to the exposed position. Movement of the pin rolling tool assembly 26b to the engaging position is accomplished in reverse fashion, with the force applying cylinder 120 applying a linear advance force to the retract carriage 116 which is locked to the reciprocating carriage by the second locking mechanism 106 thereby moving the pin rolling tool assembly 26b to the engaging position where the first and second locking mechanisms 104 and 106 release the pin rolling tool assembly 26b and the rolling force cylinder pushes the upper and lower arms 68 and 70 to engage the rolling tools 78 and 80 with the pin 34.

Shifting movement of the pin rolling tool assembly 26b in a direction parallel the rotational axis 30 for alignment with any particular crankshaft configuration is provided by adjustment guide rails 122, an adjustment rack 124, and a selective adjustment means 126 attached to the retract guide rail 96 of each pin rolling tool assembly 26b as shown in FIG. 3B. The adjustment guide rails 122 and the adjustment rack 124 are fixed to the upper stationary member 98 of the frame 28 and extend parallel to the rotational axis 30. The retract guide rail 96 of each pin rolling tool assembly 26b is mounted to the adjustment guide rails 122 by linear bearings 127 for selective movement parallel to the rotational axis 30 along the adjustment guide rails 122. Each pin rolling tool assembly 26b is positioned along the adjustment guide rails 122 by its selective adjustment means 126 which includes a rotatable shaft 128 mounted in a bearing block 129 fixed to the retract guide rail 96 for rotation about its axis. A pinion 130 is fixed the shaft and is meshed with the adjustment rack 124, and a locking clamp 132 for locking the shaft 128 and the pinion 130 against rotation. To adjust a pin rolling tool assembly 26b, the locking clamp 132 is loosened to allow rotation of the shaft 128 and the pinion 130. The shaft 128 is then rotated, thereby rotating the pinion 130 to progressively engage the gear teeth of the pinion 130 and the adjustment rack 124. This drives the pin rolling tool assembly 26b along the adjustment rails 122 until the pin rolling tool assembly 26b is aligned with the crankshaft 22 and rotation of the shaft 128 is halted. The locking clamp 132 is then tightened to prevent rotation of the shaft 128 and the pinion 130, thereby locking the pinion 130 against the adjustment rack 124 and preventing subsequent movement of the pin rolling means 26b along the adjustment guide rails 122.

As best seen in FIG. 4B, deep fillet rolling of the main bearings 32 of the crankshaft 22 is provided by the main bearing rolling tool assemblies 26a, each of which includes an upper rotating lever arm 134 and a lower fixed lever arm 136. Each arm has an engaging end 138 and 140 operably holding a rolling tool 142 and 144 for engagement with the main bearings 32 and a lever end 146 and 148 pivotally engaging a rolling force cylinder 150. The lever arms 134 and 136 are each mounted on a common pivot pin 152 carried by a block 153 with their engaging ends 138 and 140 opposing each other and their lever ends 146 and 148 opposing each other. The rolling force cylinder is pinned at one end to lever 148; and its piston rod 151 is pinned to and pushes against the lever end 146. Thus, the cylinder rotates the opposed lever arms 134 and 136 about the pivot 152 and forcing the rolling tools 142 and 144 mounted in the engaging ends 138 and 140 into forcible engagement with the main bearings 32 for deep fillet rolling.

The main bearing rolling assemblies 26a are mounted to slide downwardly and away from the active rolling position, as shown in FIG. 4B, to the inactive, crankshaft exposing position of FIG. 4C. To this end, each of individual main rolling tool assemblies is mounted on a main mounting means 154 that comprises a slide or carriage 156 that slides along an inclined, stationary guide or slide 158 mounted on an inclined stationary base pedestal 159 which is secured to the lower frame base 28. Each retract carriage 156 supports one of the main bearing rolling tool assemblies 26a, and has linear bearings 158 that are mated to and slide along to a retract guide rail 160 for movement along an axis perpendicular to the rotational axis 30 of the crankshaft 32. The preferred angle of inclination of the guide rail is about 45 degrees from horizontal to provide clearance for the rolling tools 144. To shift the main rolling assemblies 26a between the active and exposed positions, main mounting means 154 also includes a hydraulic force cylinder 162 fixed to a bracket 163 secured to the retract guide rail 160. A piston rod 165 extends from the cylinder and has an end fastened to the retract carriage 156 for applying force to shift the retract carriage 156 and the main bearing rolling means 26a mounted thereon relative to the retract guide rail 160 and the crankshaft 22.

To move the main bearing rolling tool assembly 26a from the engaging position to the return position, the rolling force cylinder 150 first pulls the upper rotating arm 134 so that it rotates about the pivot 152 and disengages the rolling tools 142 and 144 from the main bearing 32. After this, the force cylinder 162 pulls inwardly its piston rod 165 and attached main bearing rolling tool assembly 26a travels downwardly along the retract guide rail 160 to the exposed position. Movement of the main rolling tool assembly 26a upwardly to the engaging position is performed in reverse manner with the force cylinder 162 extending its piston rod and pushing the main bearing rolling tool assembly 26a upwardly along the inclined, guide rail 160 to the engaging position. The rolling force cylinder 150 is then actuated to extend its piston rod 151 thereby forcing apart the rotatable lever arms 134 and 136 rotating them about the pivot 152 and engaging the respective rolling tools 142 and 144 with the main bearing 32.

The main rolling tool assembly 26a like the pin rolling assemblies can be shifted laterally relative to the frame to be set up for a particular crankshaft configuration. The crankshaft itself is shifted laterally to have one set of main bearings rolled and then to have another set of main bearings rolled. But to position the main rolling assemblies 26b between a first rolling position for rolling the in-line crankshaft (FIG. 5A) and the V-8 crankshaft (FIG. 5B), the guide rails 160 act as a slidable cross carriage that is slidable along a set of four parallel, laterally-extending, adjustment guide rails 164 fastened to a top, inclined plate 170 fixed to the stationary pedestal. The guide rails are shifted laterally by a rack and pinion assembly that includes a pair of horizontally-extending racks 166 positioned between and disposed parallel to the adjustment guide rails and fastened to the inclined stationary plate 170. The racks are positioned beneath a pair of meshed pinions 176 fixed to a rotatable drive shaft 174 mounted in bearing blocks 175 on each adjustment guide rail 164.

Each pin rolling tool assembly 26*a* is locked in position along the adjustment guide rails 164 by a locking clamp 178 for locking the shaft 174 and the pinions 176 against rotation. To adjust a main rolling tool assembly 26*a*, the locking clamp 178 is loosened to allow rotation of the shaft 174 and the pinions 176. The shaft 174 is then rotated, thereby rotating the pinions 176 to progressively engage the gear teeth of the pinions 176 and the adjustment racks 166. This drives the main rolling tool assembly 26*a* along the adjustment guide rails 164 until the main rolling tool assembly 26*a* is aligned with the crankshaft 22 and rotation of the shaft 174 is halted. The locking clamp 178 is then tightened to prevent rotation of the shaft 174 and the pinions 176, thereby locking the pinions 176 against the adjustment racks 166 and preventing subsequent movement of the main rolling tool assembly 26*a* along the adjustment guide rails 164.

What is claimed is:

1. An apparatus for simultaneously deep fillet rolling multiple crankshaft main bearings and pins to increase the fatigue strength thereof, comprising:

a frame;

support means on the frame for supporting and rotating a crankshaft in a working position;

a plurality of pin rolling means for deep rolling the pin fillets of the crankshaft;

pin mounting means for movably mounting the pin rolling means on the frame for movement between an engaging position, where the pin rolling means engage the crankshaft for rolling, and a retracted position, where the pin rolling means are shifted away from the crankshaft to expose the crankshaft and the working position for operations other than rolling;

a plurality of main rolling means for deep rolling the main bearing fillets of the crankshaft; and main mounting means for mounting the main rolling means on the frame for movement between an engaging position, where the main rolling means engage the crankshaft for deep rolling, and a retracted position, where the main rolling means are positioned to expose the crankshaft and the working position for operations other than rolling.

2. An apparatus in accordance with claim 1 wherein the main mounting means comprises a slide carrier means carrying the main rolling means, and a downwardly-inclined support on the frame supporting the slide carrier means for downwardly-inclined travel away from the crankshaft and the pin rolling means.

3. An apparatus in accordance with claim 1 wherein the slide carrier means comprises a cross carrier means for carrying the main rolling means for shifting movement in a direction parallel to the rotational axis of the crankshaft.

4. An apparatus in accordance with claim 1 wherein the pin mounting means comprises a slidable carriage means for carrying the pin rolling means away from the crankshafts, and means for carrying the pin rolling means for shifting movement in a direction parallel to the rotational axis of the crankshaft.

5. An apparatus in accordance with claim 1 wherein the pin mounting means comprises a pin carrier movable along the frame toward and from the crankshaft in traveling between the engaging position and the retracted position, and means mounting the pin carrier for shifting laterally along the frame in a direction parallel to the crankshaft axis; and wherein the main mounting means comprises a carrier movable along the frame toward and from the crankshaft in traveling between the engaging position and the retracted position and means mounting the carrier for shifting laterally in a direction parallel to the crankshaft axis.

6. An apparatus in accordance with claim 1 wherein the supporting means for the crankshaft comprises a slidable carriage means on the frame movable to shift the crankshaft in an axial direction from a first rolling position for rolling of a first set of pin and main bearings to a second position aligning a second set crankshaft pin and main bearings for engagement with the pin and main rolling means, respectively.

7. An apparatus in accordance with claim 6 wherein the carriage means comprises left and right carriages for supporting left and right ends of the crankshaft, at least one of the carriages being movable independently of the other carriage to clamp or unclamp a crankshaft for rotation between the carriages.

8. An apparatus for simultaneously deep fillet rolling multiple crankshaft main and pin bearings to increase the fatigue strength thereof, comprising:

a frame;

support means on the frame for supporting and rotating a crankshaft in a working position;

a plurality of pin rolling means for deep rolling the pin fillets of the crankshaft;

pin mounting means for movably mounting the pin rolling means on the frame for movement between an engaging position, where the pin rolling means engage the crankshaft for rolling, and a retracted position, where the pin rolling means are shifted away from the crankshaft;

a plurality of main rolling means for deep rolling the main bearing fillets of the crankshaft;

a slidable carriage means slidable on the frame and carrying the main rolling means between an engaging position, where the main rolling means engage the crankshaft for deep rolling main fillets, and a retracted position, with the main rolling means spaced from the crankshaft; and a cross carrier means for carrying the main rolling means in a direction parallel to the rotational axis of the crankshaft.

9. An apparatus in accordance with claim 8 wherein a downwardly-inclined support is provided on the frame, the cross carrier means being mounted at an incline on the inclined support and traveling laterally along the inclined support; and the slidable carriage being mounted on the inclined cross carrier for sliding movement in a downwardly inclined direction away from the crankshaft in a path perpendicular to the rotational axis.

10. An apparatus in accordance with claim 8 wherein a fluid cylinder drive is connected to the slidable carriage to drive it upwardly or downwardly along the inclined support; and a rack pinion drive is connected to the inclined cross carrier and the inclined support to shift the slidable carriage and the main rolling means thereon in a lateral direction parallel to the axis of the crankshaft.

11. An apparatus for deep rolling of fillets on pin and main bearings of a crankshaft, the apparatus comprising:

a frame;

a plurality of pin and main rolling means on the frame;

means mounting the pin and main rolling means for movement into a rolling position for rolling engagement with the crankshaft and for movement to a spaced position spaced away from the crankshaft to allow the crankshaft to move laterally in a direction parallel to axis of rotation of the crankshaft;

a rotational support means on the frame for rotating the crankshaft while a first set of pin and main bearings are being engaged and rolled by the pin and main rolling means; and translation means on the frame for translating the rotational support means and the crankshaft thereon in a direction parallel to crankshaft axis while the pin and main rolling means are in the spaced position to align a second set of pin and main bearings with the rolling means for rolling subsequent to the rolling of the first set of pin and main bearings.

12. An apparatus in accordance with claim 11 wherein the translation means comprises a slidable carriage means slidable on the frame and having a chuck and spindle means to rotate the crankshaft.

13. An apparatus in accordance with claim 12 wherein the slidable carriage means comprises left and right-hand carriages and a common drive connected to the left and right carriages to shift them together simultaneously along the frame to the respective positions for rolling the first and second sets of pin and main bearings.

14. An apparatus in accordance with claim 13 wherein a sub-carriage is slidably mounted on one of the left or right carriage means for sliding relative thereto in the axial direction relative to the other of the carriages to release the crankshaft for removal.

15. An apparatus in accordance with claim 13 wherein cross slide means on the frame mounts the pin rolling means and the main rolling means for separate movement in an axial direction for alignment with differently-positioned pin and main bearings on different designs of crankshafts.

16. An apparatus in accordance with claim 15 including lockout means to lockout a pin rolling means or a main rolling means not needed for a particular crankshaft rolling operation in a retracted position.

17. An apparatus for simultaneously deep fillet rolling multiple crankshaft main and pin bearings to increase the fatigue strength thereof, comprising:

a frame;

support means on the frame for supporting and rotating a crankshaft in a working position;

the support means including positioning means for moving the crankshaft axially relative to the main rolling means and the pin rolling means to sequentially position groups of the crankshaft main bearings and pins relative to the main rolling means and the pin rolling means for sequential deep rolling of the groups;

a plurality of main rolling means for deep rolling the main bearing fillets of the crankshaft;

main mounting means for movably mounting the main rolling means on the frame for movement between an engaging position, where the main rolling means engage the crankshaft for deep rolling, and a retracted position, where the main rolling means are positioned to expose the crankshaft and the working position for operations other than rolling;

a plurality of pin rolling means for deep rolling the pin fillets of the crankshaft;

pin mounting means for movably mounting the pin rolling means on the frame for movement between an engaging position, where the pin rolling means engage the crankshaft for rolling, and a retracted position, where the pin rolling means are positioned to expose the crankshaft and the working position for operations other than rolling;

the main mounting means including a carriage guided perpendicular to the rotational axis of the crankshaft along guide means mounted to the frame for said movement reciprocal between the engaging position and the retracted position;

the pin mounting means including a carriage guided perpendicular to the rotational axis of the crankshaft along guide means mounted to the frame for said movement reciprocal between the engaging position and the retracted position;

the frame including upper support members and lower support members;

the main mounting means mounting the main rolling means to the lower support members;

the pin mounting means mounting the pin rolling means to the upper support members;

the pin rolling means including slide means and pivot means for guiding the pin rolling means to follow the oscillation of the pins as the crankshaft is rotated with the pin rolling means engaging the crankshaft;

the slide means including a carriage guided on the frame for movement of the pin rolling means perpendicular to the rotational axis of the crankshaft in the working position;

the pivot means including strut rigidly mounted to the carriage; and the strut including a pivot to allow pivoting movement of the pin rolling means.

* * * * *